US009324492B2

(12) United States Patent
Heo

(10) Patent No.: US 9,324,492 B2
(45) Date of Patent: Apr. 26, 2016

(54) MAGNETIC DEVICE

(71) Applicant: LSIS CO., LTD., Anyang-si, Gyeonggi-do (KR)

(72) Inventor: Min Heo, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/286,726

(22) Filed: May 23, 2014

(65) Prior Publication Data

US 2015/0102894 A1 Apr. 16, 2015

(30) Foreign Application Priority Data

Oct. 14, 2013 (KR) ..... 10-2013-0122256

(51) Int. Cl.
*H01F 27/30* (2006.01)
*H01F 17/04* (2006.01)
*H01F 27/26* (2006.01)

(52) U.S. Cl.
CPC ..... *H01F 27/306* (2013.01); *H01F 27/263* (2013.01)

(58) Field of Classification Search
CPC ..... H01F 5/02; H01F 17/043; H01F 17/06; H01F 27/263; H01F 27/266; H01F 27/325; H01F 27/30; H01F 27/306
USPC ..... 336/198, 208, 212, 221, 220, 210
See application file for complete search history.

(56) References Cited

U.S. PATENT DOCUMENTS

2006/0192648 A1* 8/2006 Suzuki ..... 336/208
2010/0026445 A1 2/2010 Lin et al.
2010/0231343 A1* 9/2010 Zeng ..... H01F 5/04 336/192
2014/0062642 A1* 3/2014 Lin et al. ..... 336/196

FOREIGN PATENT DOCUMENTS

JP 55-71512 5/1980
JP 55-110010 A * 8/1980

(Continued)

OTHER PUBLICATIONS

European Patent Office Application Serial No. 14177924.9, Search Report dated Feb. 26, 2015, 5 pages.

(Continued)

*Primary Examiner* — Mangtin Lian
(74) *Attorney, Agent, or Firm* — Lee Hong Degerman Kang & Waimey; Jonathan Kang; Jeffrey Lotspeich

(57) ABSTRACT

A magnetic device is provided. The magnetic device includes a bobbin including a hollow portion extending in a longitudinal direction, coils wound around the outside of the bobbin, a core coupled to the bobbin outside the bobbin. The bobbin includes a first winding portion around which the coil is wound, a second winding portion which is disposed at one side of the first winding portion in the longitudinal direction, and around which the coil is wound, a tolerance relief part disposed between the first and second winding portions, coupling parts symmetrically disposed to each other on the outsides of the first and second winding portions, respectively. The tolerance relief part is elastically deformable in the longitudinal direction.

10 Claims, 8 Drawing Sheets

(56) References Cited

FOREIGN PATENT DOCUMENTS

| | | |
|---|---|---|
| JP | 60-094806 | 6/1985 |
| JP | 61-112611 | 7/1986 |
| JP | 64-89304 | 4/1989 |
| JP | 01-67712 | 5/1989 |
| JP | 11-186077 | 7/1999 |
| JP | 2003-036745 | 2/2003 |
| JP | 2006-237420 | 9/2006 |
| WO | 85/01387 | 3/1985 |

OTHER PUBLICATIONS

Japan Patent Office Application Serial No. 2014-125450, Office Action dated Sep. 8, 2015, 3 pages.

* cited by examiner

- PRIOR ART -

MAGNETIC DEVICE

CROSS-REFERENCE TO RELATED APPLICATIONS

Pursuant to 35 U.S.C. §119(a), this application claims the benefit of earlier filing date and right of priority to Korean Patent Application No. 10-2013-0122256, filed on Oct. 14, 2013, the contents of which are hereby incorporated by reference herein in its entirety.

BACKGROUND

The present disclosure relates to a magnetic device, and particularly, to a magnetic device in which a bobbin is elastically deformable in length to relieve an assembly tolerance.

Typical magnetic devices such as inductors or transformers include cores and coils, in which inductance vary with number of rotation of the coil.

In general, at least two cores are provided in the magnetic device. Such typical magnetic devices use a bobbin to insulate the coil and the core from each other and to secure the number of rotations smoothly.

FIG. 1 is a perspective view of a typical magnetic device.

The typical magnetic device illustrated in FIG. 1 includes a core 10 and a bobbin 20. The magnetic device has a structure in which a coil 30 is wound around the outside of the bobbin 20, and the core 10 is coupled to both sides of the bobbin 20.

Here, the core 10 is provided with a first core 11 and a second core 12, and the two cores 11 and 12 are coupled to each other using an adhesive or an adhesion tape. There have been methods in which the adhesive is supplied to portions where the two cores 11 and 12 are in contact with each other, or in which the adhesion tape is used to surround the outside of ends of the two cores 11 and 12 that are in contact with each other. However, if a gap between the ends of the two cores is formed in the adhesion process, deviation occurs in the inductance, and thus it is difficult to manufacture products having precise specifications.

In recent years, as electronic devices and components have been developed to have high-performance and shrunk in size, structures capable of removing such a gap and improving assembly accuracy are being required.

SUMMARY

Embodiments provide a magnetic device capable of improving assembly accuracy and simplifying a manufacturing process to reduce manufacturing costs.

In one embodiment, a magnetic device includes: a bobbin including a hollow portion extending in a longitudinal direction; coils wound around the outside of the bobbin; a core coupled to the bobbin outside the bobbin; wherein the bobbin includes: a first winding portion around which the coil is wound; a second winding portion which is disposed at one side of the first winding portion in the longitudinal direction, and around which the coil is wound; a tolerance relief part disposed between the first and second winding portions; coupling parts symmetrically disposed to each other on the outsides of the first and second winding portions, respectively; wherein the tolerance relief part is elastically deformable in the longitudinal direction.

Each of the coupling parts may include a hook latched on an outer surface of the core in the longitudinal direction.

The tolerance relief part may have a curved shape that protrudes or is recessed in a width direction perpendicular to the longitudinal direction.

The coils may include a first coil and a second coil; the tolerance relief part has a curved shape protruding in the width direction that is perpendicular to the longitudinal direction; and the first and second coils are spaced apart from each other with the tolerance relief part disposed therebetween.

The magnetic device may further include a partition wall protruding outside outward in the width direction from a boundary between the winding part and the coupling part.

The magnetic device many further include a reinforcement disposed on the outside of the partition wall 240 in the longitudinal direction and the outside of the coupling part 230 in the width direction.

The core may include: an end part on which the hook is latched; and a central part extending inward from the end part in the longitudinal direction, wherein the central part is insertable into the hollow portion of the bobbin.

The magnetic device may further include an outer extending part extending in parallel with the central part from the outside of the central part disposed in the width direction of the central part.

The end part may have a shape in which at least one portion gradually increases in width from the center to the outside when viewed in the longitudinal direction.

The tolerance relief part may surround an entire circumference of the bobbin in the width direction.

The details of one or more embodiments are set forth in the accompanying drawings and the description below. Other features will be apparent from the description and drawings, and from the claims.

DETAILED DESCRIPTION OF THE EMBODIMENTS

Hereinafter, a movable terminal according to an embodiment will be described with reference to the accompanying drawings.

Figure 2:
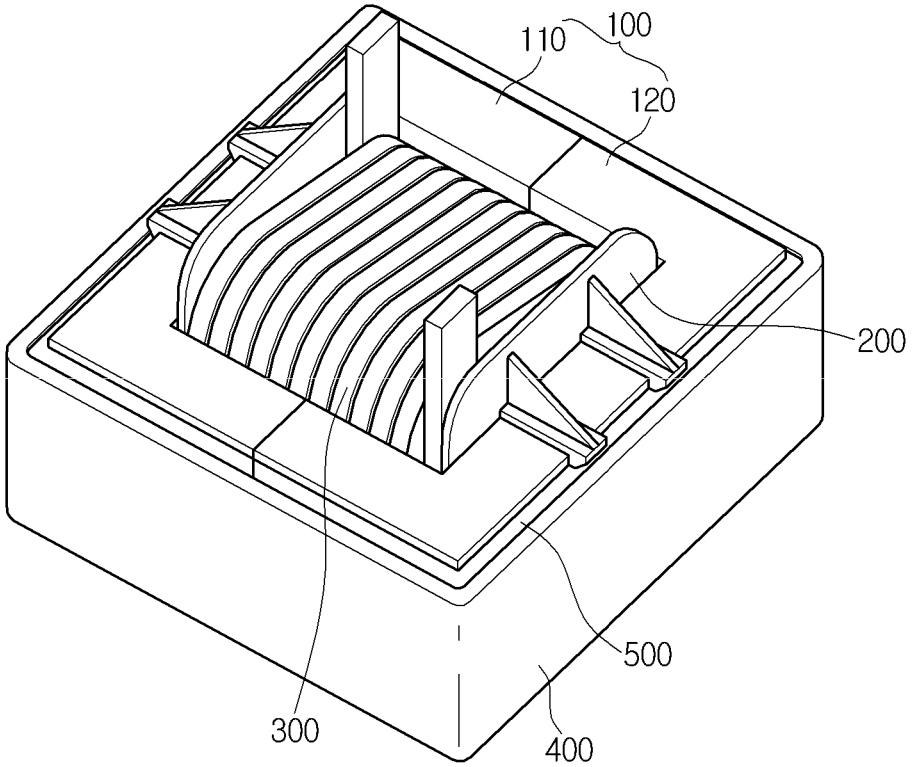
FIG. 2 is a perspective view of a magnetic device according to an embodiment.
Figure 3:
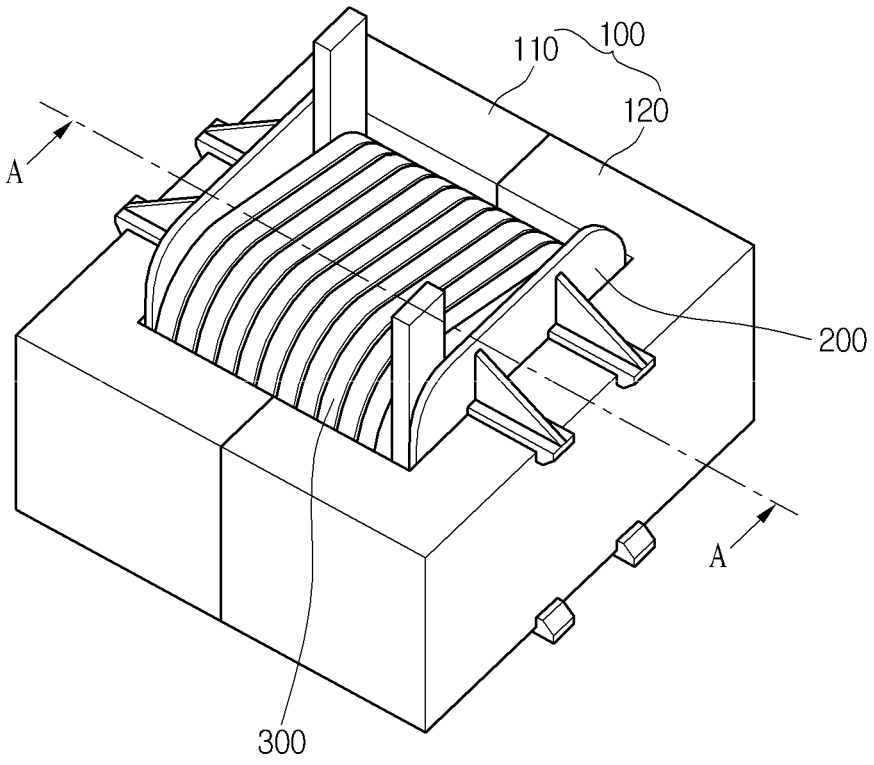
FIG. 3 is a perspective view of a portion of the magnetic device according to an embodiment.
Figure 4:
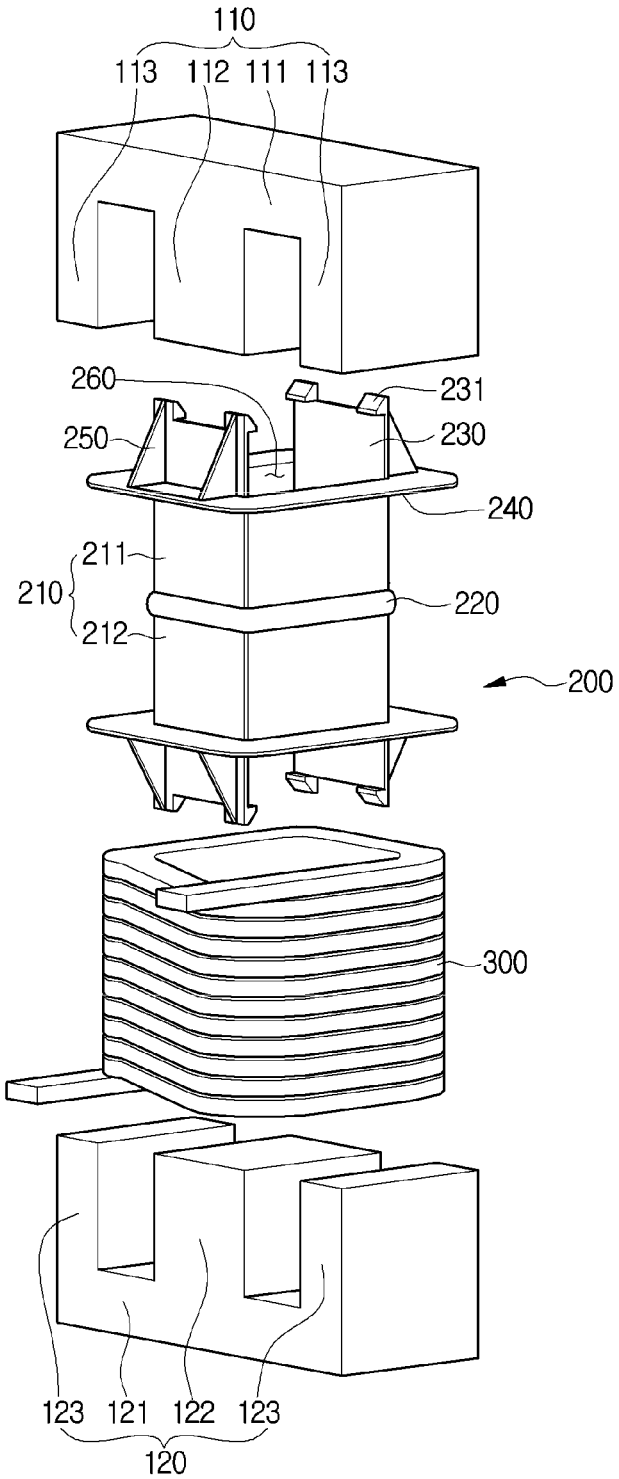
FIG. 4 is an exploded perspective view of the magnetic device illustrated in FIG. 3.
Figure 5:
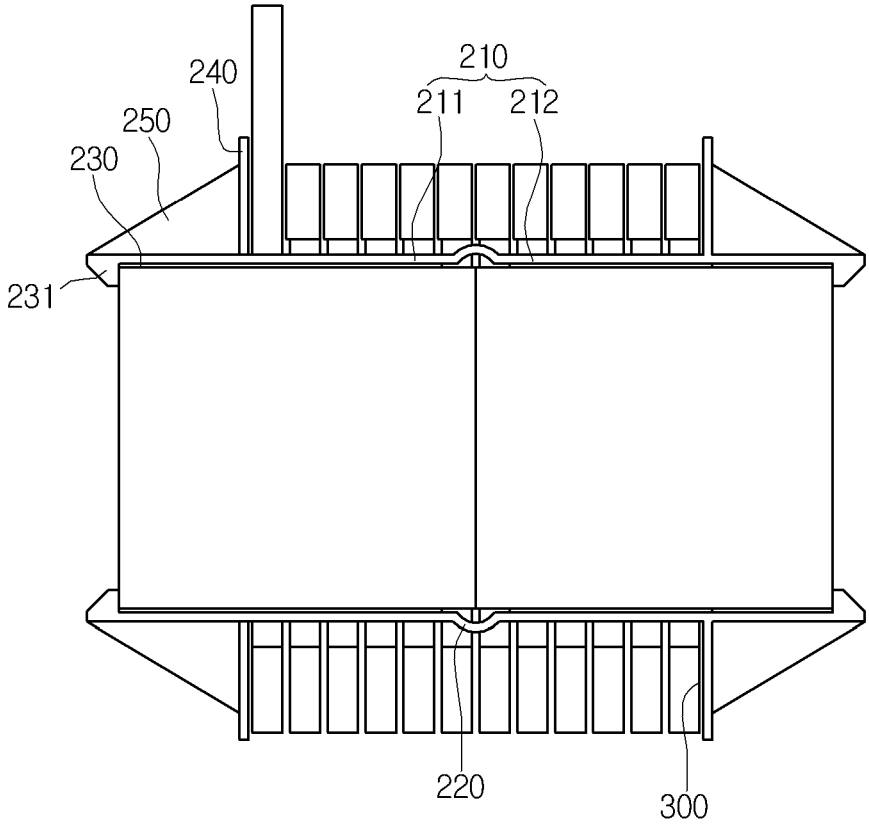
FIG. 5 is a side cross-sectional view taken along line A-A of FIG. 3.
Figure 6:
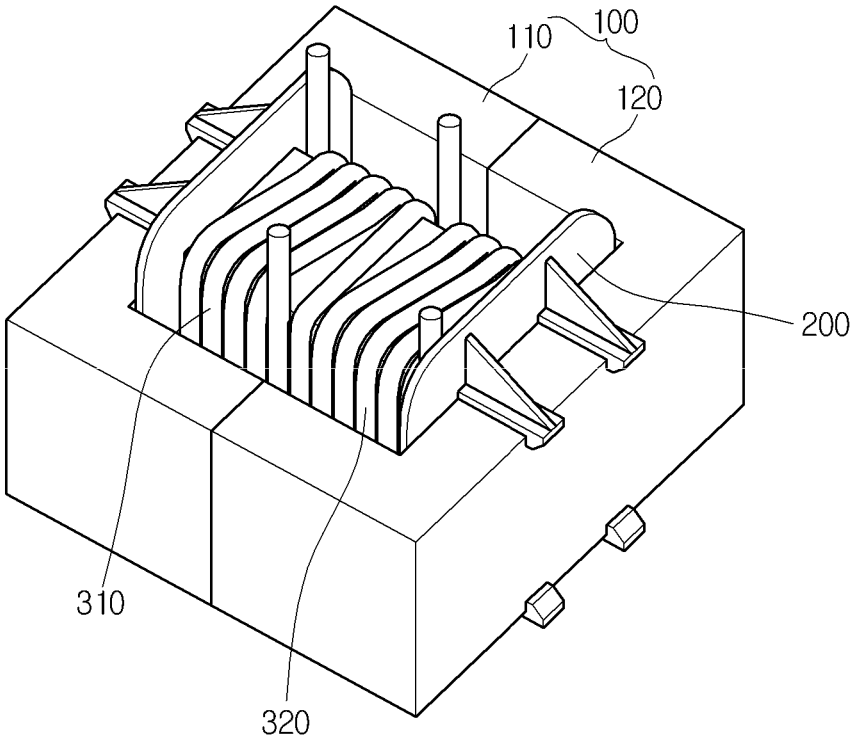
FIG. 6 is a perspective view illustrating a state where two coils are provided in the magnetic device according to an embodiment.

FIG. 2 is a perspective view of a magnetic device according to an embodiment, FIG. 3 is a perspective view of a portion of the magnetic device according to an embodiment, FIG. 4 is an exploded perspective view of the magnetic device illustrated in FIG. 3, FIG. 5 is a side cross-sectional view taken along line A-A of FIG. 3, and FIG. 6 is a perspective view illustrating a state where two coils are provided in the magnetic device according to an embodiment.

Referring to FIGS. 2 and 6, a magnetic device according to an embodiment includes a core 100, a bobbin 200, a coil 300, and a case 400.

The core 100 is provided in plurality. That is, at least two bobbins are provided. Although it is illustrated that two cores 100 are provided in the current embodiment, the present disclosure is not limited thereto.

The core 100 includes a first core 110 and a second core 120 parallelly disposed in a longitudinal direction.

The first core 110 includes an end part 111, a central part 112, and outer extending parts 113.

The end part 111 may have the shape of a plate extending in a width direction crossing the longitudinal direction and have an approximately rectangular shape. Here, the width direction may be perpendicular to the longitudinal direction.

The central part 112 extends inward from the center of the end part 111 in the longitudinal direction.

The outer extending parts 113 extend inward from edges of the end part 111 in the longitudinal direction. That is, the outer extending parts 113 extend in parallel with the central part 112 from left and right outer sides of the central part 112 which are disposed in the width direction of the central part 112. Number of the outer extending parts 113 provided in one core may be two.

The second core 120 includes an end part 121, a central part 122, and outer extending parts 123, as in the first core 110. The second core 120 has the substantially same structure as the first core 110, and the first and second cores 110 and 120 are symmetrically disposed to each other in the longitudinal direction. That is, the end part 121, the central part 122, and the outer extending parts 123 constituting the second core 120 are substantially the same as and symmetric in the longitudinal direction to the end part 111, the central part 112, and the outer extending parts 113 constituting the first core 110. Thus, description for the detailed structure of the second core 120 will be omitted herein.

The bobbin 200 includes a winding part 210, a tolerance relief part 220, a coupling part 230, a partition wall 240, and a reinforcement 250. Also, a hollow portion 260 extending in the longitudinal direction is defined inside the bobbin 200. That is, the bobbin 200 is shaped such that the inside thereof is empty. The hollow portion 260 is defined to pass through the bobbin 200 in the longitudinal direction.

The winding part 210 of which the inside is empty lengthily extends in the longitudinal direction. The central part of the core 100 may be inserted into the empty space of the winding part 210. That is, the winding part 210 may have one side into which the central part 112 of the first core 110 is inserted, and the other side into which the central part 122 of the second core 120 is inserted. The winding part 210 may have a polygonal section, for example, may have an approximately rectangular section. However, the present disclosure is not limited thereto. The winding part 210 may include a first winding portion 211 and a second winding portion 212. Here, a boundary between the first and second winding portions 211 and 212 may be partitioned by the tolerance relief part 220 that will be described later. That is, on the basis of the tolerance relief part 220, one portion of the winding part 210 may be the first winding portion 211 and the other portion of the winding part 210 may be the second winding portion 212.

The tolerance relief part 220 is disposed at a predetermined position in the winding part 210. That is, the tolerance relief part 220 is disposed between the first and second winding portions 211 and 212. The tolerance relief part 220 is formed of a material or has a shape, which is elastically deformable in a length direction. The tolerance relief part 220 may surround an entire circumference of the winding part 210 in the width direction. However, the present disclosure is not limited thereto, and the tolerance relief part 220 may be disposed on a portion of the circumference of the winding part 210 in the width direction. Meanwhile, the tolerance relief part 220 may have a curved surface shape that is protruded outward or recessed inward. Also, the first winding portion 211, the second winding portion 212, and the tolerance relief part 220 may be integrally formed. Thus, when an external force is applied to extend the bobbin 200 in the longitudinal direction, the curved surface of the tolerance relief part 220 may be spread, that is, a radius of curvature may decrease, resulting in extension of the bobbin 200 in the longitudinal direction. Accordingly, when the magnetic device according to an embodiment is assembled, the tolerance relief part 220 may extend to relieve an assembly tolerance between lengths of the bobbin 200 and the core in the longitudinal direction. Here, even in a state where the tolerance relief part 220 extends, a restoring force allowing the tolerance relief part 220 to be returned to its original shape may be applied to the tolerance relief part 220.

When the coil 300 wound around the outside of the winding part 210 is provided in plurality, the tolerance relief part 220 may serve as a mark of marking a position where each of the coils 300 is wound. In this case, it may be more desirable that the tolerance relief part 220 protrudes outward rather than being recessed inward. Therefore, the tolerance relief part 220 may be disposed between the plurality of coils 300 and divide boundaries between the coils.

Alternatively, the tolerance relief part 220 may not have a shape that protrudes outward or is recessed inward. That is, the tolerance relief part 220 may extend by being elastically deformed in the longitudinal direction due to material property, not due to a figural characteristic such as a protruded shape or a recessed shape. In this case, the tolerance relief part 220 may be formed of a material different from materials of the first and second winding portions 211 and 212, and, for example, the tolerance relief part 220 may be formed of rubber and the like.

Meanwhile, at least one tolerance relief part 220 may be provided. That is, the tolerance relief part 220 may be provided in plurality.

The coupling parts 230 are disposed on both ends of the winding part 210 in the longitudinal direction. That is, the coupling parts 230 are disposed on an outer end of the first winding portion 211 in the longitudinal direction and on an outer end of the second winding portion 212 in the longitudinal direction, respectively. Each of the coupling part 230 extends in the longitudinal direction, and a plurality of hooks 231 are disposed on outer ends thereof.

The partition wall 240 protrudes and extends outward in the width direction from the boundary between the coupling part 230 and the winding part 210. The partition wall 240 is provided in a pair symmetric to each other. That is, the pair of partition walls 240 are disposed on the outside of the first winding portion 211 and the outside of the second winding portion 212, respectively.

The reinforcement 250 is disposed on the outside of the partition wall 240 in the longitudinal direction and the outside of the coupling part 230 in the width direction. An inner end of the partition wall 240 disposed in the longitudinal direction contacts an outer surface of the partition wall 240 in the longitudinal direction and an inner end of the partition wall 240 disposed in the width direction contacts an outer surface of the coupling part 230 in the width direction. The reinforcement 250 decreases in widthwise height toward the outside of the longitudinal direction. The reinforcement 250 reinforces the strength of the coupling part 230. When a great force is applied to the coupling part 230 in a magnetic device coupling process, the coupling part 230 may be damaged. Thus, when the reinforcement 250 is provided, it is possible to reinforce the strength of the coupling part 230 to thereby prevent the coupling part 230 from being damaged.

The coil 300 is wound around the outside of the bobbin 200. In more detail, the coil is wound around the outside of the winding part 210 and between the pair of partition walls 240. When the coil 300 is provided in plurality, the coils 300 may be spaced apart from each other using the tolerance relief part 220 as the boundary.

For reference, FIG. 6 is a view illustrating the plurality of coils 310 and 320. The first and second coils 310 and 320 are wound around both sides of the tolerance relief part 220, respectively. The first and second coils 310 and 320 are spaced apart from each other with the tolerance relief part 220 disposed therebetween. Each of the coils 300 is formed of a highly conductive material such as copper.

Figure 1:
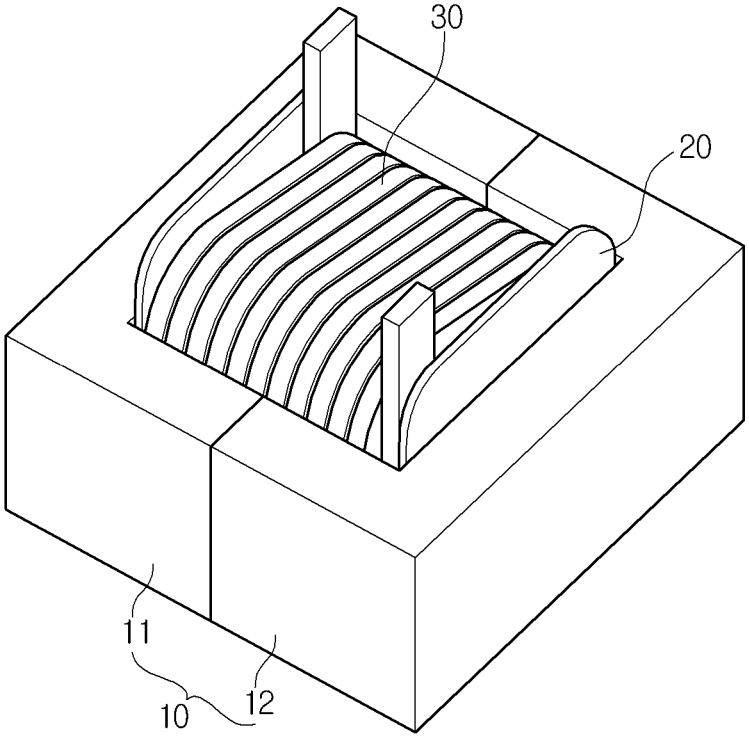
FIG. 1 is a perspective view of a typical magnetic device.

The case 400 surrounds the outside of the core 100 as illustrated in FIG. 1. The case 400 may be formed of a material such as aluminum, and an epoxy molding 500 may be disposed between the case 400 and the core 100.

Hereinafter, a process of assembling the magnetic device having the above-described structure will be described.

First, the coil 300 is wound around the outside of the bobbin 200. In more detail, the coil is wound around the outside of the winding part 210 and between the pair of partition walls 240. Here, when the coil 300 is provided in plurality, the coils 300 may be wound such that they are spaced apart from each other using the tolerance relief part 220 as the boundary.

After the coils 300 are wound around the outside of the bobbin 200, the bobbin 200 is coupled to the core 100. The first core 110 is coupled to the first winding portion 211, and the second core 120 is coupled to the second winding portion 212.

When the bobbin 200 is coupled to the core 100, the hook 231 disposed on the outer end of the coupling part 230 of the bobbin 200 is latched to the outer surface of the core in the longitudinal direction. During this process, the length of the tolerance relief part 220 may extend. Since the tolerance relief part 220 tends to return to its original shape due to the elastic restoring force in a state where the tolerance relief part 220 is elastically deformed to be elongated, the coupling part 230 pressurizes inward the outer surface of the core in the longitudinal direction due to the restoring force. Therefore, a force pulling the core inward in the longitudinal direction is always applied to the core 100.

Accordingly, the force pulling each other is always applied to the pair of cores 110 and 120, and thus the cores 110 and 120 are not spaced apart from each other and easily assembled. That is, an additional process for attaching the first and second cores 110 and 120 to each other on the contact surface thereof is not required or is simplified, and thus the manufacturing process of the magnetic device may be simplified.

Hereinafter, a magnetic device according to another embodiment will be described with reference to FIGS. 7 and 8.

Figure 7:
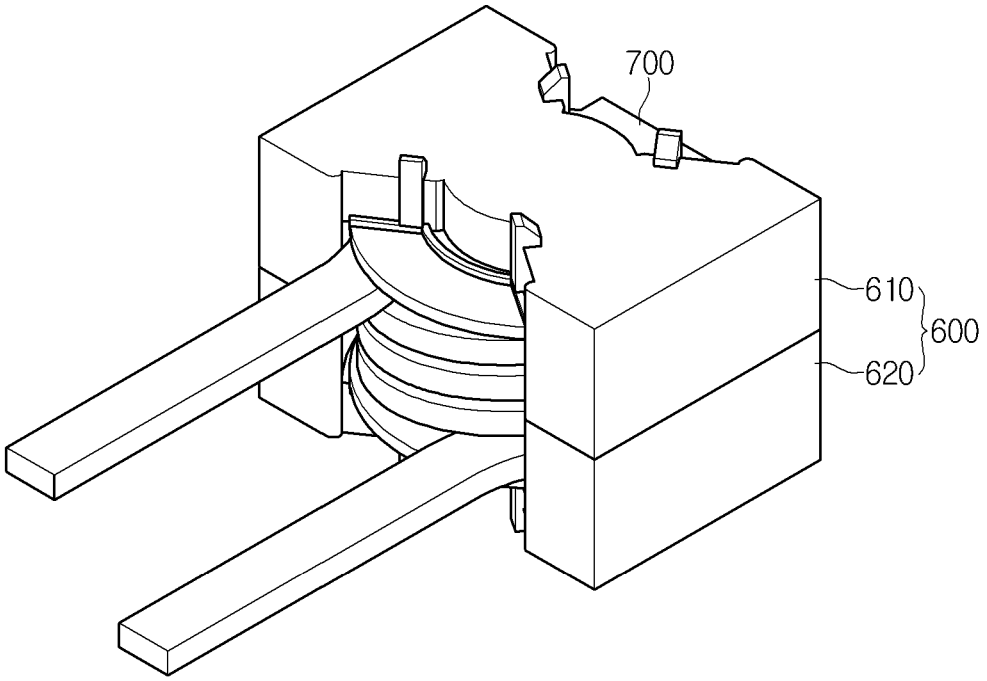
FIG. 7 is a perspective view of a magnetic device according to another embodiment.
Figure 8:
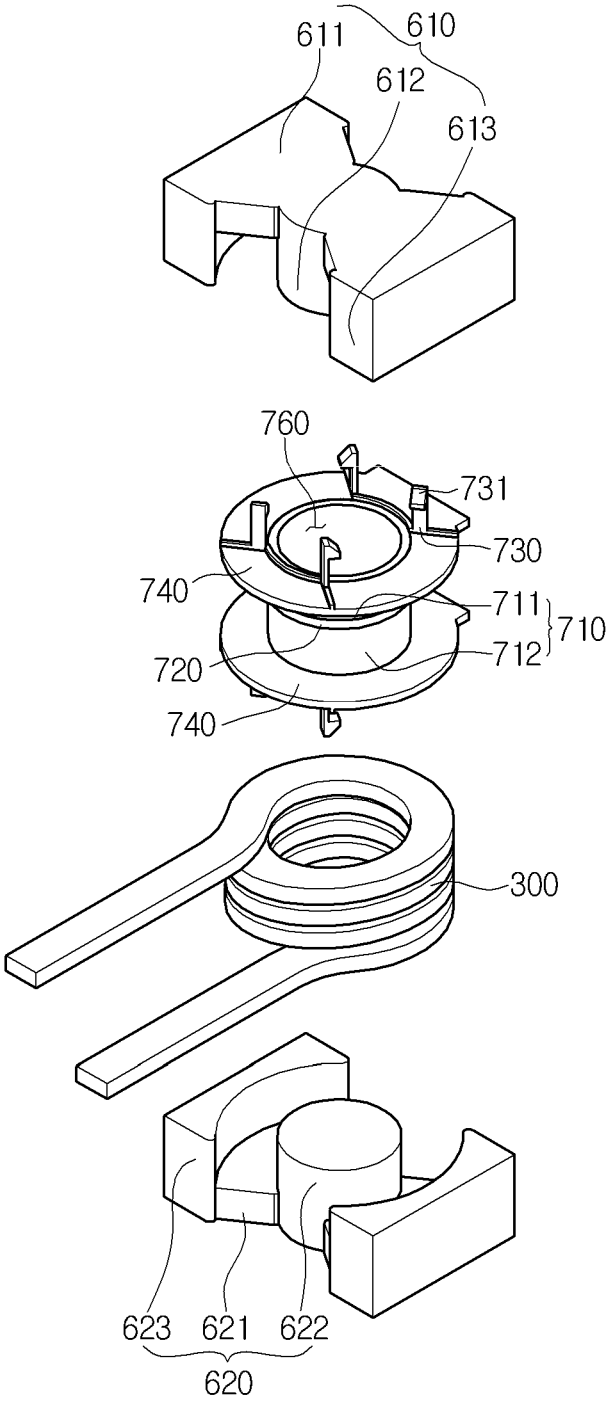
FIG. 8 is an exploded perspective view of a magnetic device according to another embodiment.

FIG. 7 is a perspective view of a magnetic device according to another embodiment, and FIG. 8 is an exploded perspective view of a magnetic device according to another embodiment.

A magnetic device described with reference to FIGS. 7 and 8 includes a core 600 and a bobbin 700 having different shapes from those of the magnetic device described with reference to FIGS. 2 to 6.

Referring to FIGS. 7 and 8, the magnetic device according to an embodiment includes the core 600, the bobbin 700, and a coil 300. Also, the magnetic device may further include a case (not shown) that surrounds the outside of the core 600.

The core 600 is provided in plurality. That is, at least two bobbins are provided. Although two cores 600 are provided in the current embodiment, the present disclosure is not limited thereto. The core 600 includes a first core 710 and a second core 720 which parallelly extends in a longitudinal direction.

The first core 610 includes an end0 part 611, a central part 612, and outer extending parts 613.

The end part 611 may have the shape of a shape extending in a width direction crossing the longitudinal direction and at least one portion thereof gradually increasing in width from a central portion thereof to the outside. In more detail, the central portion of the end part 611 has a circular shape, and the end part 611 has a width that gradually increases outward from the central portion thereof in the width direction.

The central part 612 extends from the end part 611 toward the center in a longitudinal direction. The central part 612 has an approximately cylindrical shape. The central part 612 extends from the center of the end part 611. Thus, each of the central parts 611 and 612 of the pair of cores 610 and 620 extends toward each other.

The outer extending parts 613 extend from in parallel with the central part 612 left and right outer sides of the central part which are disposed in the width direction of the central part 612. That is, the outer extending parts 613 extend along the longitudinal direction. The number of outer extending parts 613 provided in any one core may be approximately two. The outer extending parts 613 extend inward from an edge of the end part 611 in the longitudinal direction. Outer surfaces of the outer extending parts 613 disposed in the width direction are formed a curved surface having the center of a curvature approximately the same as that of the central part 612. Inner surfaces of the outer extending parts 613 disposed in the width direction are formed of a curved surface parallelly extending and facing the outer surface of the central part disposed in width direction.

The second core 620 includes an end part 621, a central part 622, and outer extending parts 623, like the first core 610. Since the second core 620 has the substantially same structure as the first core 610 and symmetrically disposed in the longitudinal direction, descriptions for the detailed structure of the second core 620 will be omitted herein.

The bobbin 700 includes a winding part 710, a tolerance relief part 720, a coupling part 730, a partition wall 740, and a reinforcement 750. Also, the bobbin 700 has an approximately cylindrical shape extending along the longitudinal direction. A hollow portion 760 extending in the longitudinal direction is defined inside the bobbin 700. The hollow portion 760 is defined to pass through the bobbin 200 in the longitudinal direction.

The winding part 710 of which the inside is empty has a cylindrical shape that lengthily extends in the longitudinal direction. The central parts 612 and 622 of the core 600 may be inserted into the empty space of the winding part 710. That is, the winding part 710 may have one side into which the central part 611 of the first core 610 is inserted and the other side into which the central part 622 of the second core 620 is inserted. The winding part 710 may be separated into a first winding portion 711 and a second winding portion 712. Here, a boundary between the first and second winding portions 711 and 712 may be partitioned by the tolerance relief part 720 that will be described below. That is, on the basis of the tolerance relief part 720, one portion of the winding part 710 may be the first winding portion 711 and the other portion of the winding part 710 may be the second winding portion 712.

The tolerance relief part 720 is disposed at a predetermined position in the winding part 710. That is, the tolerance relief part 720 is disposed between the first and second winding portions 711 and 712. The tolerance relief part 720 is formed of a material or has a shape, which is elastically deformable in a length direction. The tolerance relief part 720 may surround a circumference of the winding part 710 in the width direction.

Also, the tolerance relief part 720 may have a curved surface shape that is protruded outward or recessed inward. In this case, the first winding portion 711, the second winding portion 712, and the tolerance relief part 720 may be integrally formed. Thus, when an external force is applied to extend the bobbin 200 in the longitudinal direction, the curved surface of the tolerance relief part 720 may be spread, that is, a radius of curvature may decrease, resulting in extension of the bobbin 700 in the longitudinal direction. Accordingly, when the magnetic device according to an embodiment is assembled, the tolerance relief part 720 may extend to relieve an assembly tolerance between the bobbin 700 and the core in the longitudinal direction.

When the coil 300 wound around the outside of the winding part 710 is provided in plurality, the tolerance relief part 720 may serve as a mark of marking a position where each of the coils 300 is wound. In this case, it may be more desirable that the tolerance relief part 720 protrudes outward rather than being recessed inward. Therefore, the tolerance relief part 720 may be disposed between the plurality of coils 300 and divide boundaries between the coils.

Alternatively, the tolerance relief part 720 may not have a shape that protrudes outward or is recessed inward. That is, the tolerance relief part 720 may extend by being elastically deformed in the longitudinal direction due to material property, not due to a figural characteristic such as a protruded shape or a recessed shape. In this case, the tolerance relief part 720 may be formed of a material that is different from materials of the first and second winding portions 711 and 712, and, for example, the tolerance relief part 720 may be formed of rubber and the like.

Meanwhile, at least one tolerance relief part 720 may be provided. That is, the tolerance relief part 720 may be provided in plurality.

The coupling parts 730 are disposed on both ends of the winding part 710 disposed in the longitudinal direction. That is, the coupling parts 730 are disposed on an outer end of the first winding portion 711 and an outer portion of the second winding portion 712, respectively. Each of the coupling parts 730 extends in the longitudinal direction, and a plurality of hooks 731 are disposed on outer ends thereof.

The partition wall 740 is protruded and extends from the boundary between the coupling part 730 and the winding part 710 outward in the width direction. The width direction is a direction that is crossing and perpendicular to the longitudinal direction. The partition wall 740 is provided in a pair symmetric to each other. That is, of the pair of partition walls 240 are disposed on the outside of the first winding portion 711 and the outside of the second winding portion 712, respectively.

The magnetic device according to the current embodiment may include a reinforcement (not shown) like previous embodiments. The reinforcement reinforces strength of the coupling part 740.

The coil 300 is wound around the outside of the bobbin 700. In more detail, the coil is wound around the outside of the winding part 710 and between the pair of partition walls 740. Since the coil is the same as that of the previous embodiment, reference numerals in the drawings will be equally used, and thus their description will be omitted.

Meanwhile, the magnetic device according to the current embodiment may include a case (not shown) surrounding the outside of the core 600, an epoxy molding disposed between the case and the core, and the like, like previous embodiments.

Hereinafter, a process of assembling the magnetic device having above-described structures will be described.

First, the coil 300 is wound around the outside of the bobbin 700. In more detail, the coil is wound around the outside of the winding part 710 and between the pair of partition walls 740. Here, when the coil 300 is provided in plurality, the plurality of coils 300 may be wound around the outside of the bobbin using the tolerance relief part 720 as the boundary.

After the coils 300 are wound around the outside of the bobbin 700, the bobbin 700 is coupled to the core 600. TA first core 610 is coupled to the first winding portion 711, and the second core 620 is coupled to the second winding portion 712.

When the bobbin 700 is coupled to the core 600, a hook 731 disposed on the outer end of the coupling part 731 of the bobbin 700 is latched to the outer surface of the core 600 disposed in the longitudinal direction. During this process, the length of the tolerance relief part 720 may extend. Since the tolerance relief part 720 tends to return to its original shape due to the elastic restoring force in a state where the tolerance relief part 720 is elastically deformed to be elongated, the coupling part 730 pressurizes inward the outer surface of the core disposed in the longitudinal direction due to the restoring force. Therefore, a force pulling the core inward in the longitudinal direction is always applied to the core 600.

Accordingly, the force pulling each other is always applied to the pair of cores 610 and 620, and thus the cores 610 and 620 are not spaced apart from each other and easily assembled. That is, an additional process for attaching the first and second cores 610 and 620 to each other on the contact surface thereof is not required, and thus the manufacturing process of the magnetic device may be simplified.

Although the tolerance relief parts 220 and 720 are disposed in the winding parts 210 and 710 in the above-described embodiments, it is not limited thereto, and the tolerance relief parts 220 and 720 may be disposed in the coupling parts 230 and 730.

According to the embodiments, the assembly of the magnetic device may increase in accuracy, and the manufacturing processes may be simplified to reduce manufacturing costs and provide the high-performance magnetic device.

If a person of ordinary skill in the art to which this invention pertains without departing from the essential characteristics of the present invention in the range described above, is only the spirit of the present invention have been described for illustrative purposes, various modifications, additions and substitutions are possible.

Therefore, to explain the embodiments disclosed in the present disclosure is not limited to the technical idea of the present disclosure, and are not limited by this embodiment without departing from the scope or spirit of the invention.

The scope of protection of the present disclosure, all the technical idea, within the scope of its equivalent shall be construed by the following claims should be construed as being included in the scope of the present disclosure.

What is claimed is:

1. A magnetic device comprising:

a bobbin including a hollow portion extending in a longitudinal direction;

coils wound around the outside of the bobbin;

a core coupled to the bobbin outside the bobbin;

wherein the bobbin comprises:

a first winding portion having a top side and a bottom side and around which the coils are wound, wherein the first winding portion is shaped to define one portion of the hollow portion of the bobbin;

a second winding portion having a top side and a bottom side and around which the coils are wound, wherein the second winding portion is shaped to define a second portion of the hollow portion of the bobbin;

a single tolerance relief part positioned between the first winding portion and the second winding portion, wherein the tolerance relief part defines a continuous circumferential curved shape having a radius and protrudes in the width direction that is perpendicular to the longitudinal direction, wherein a top side of the tolerance relief part is attached to the bottom side of the first winding portion and a bottom side of the tolerance relief part is attached to the top side of the second winding portion, and wherein the tolerance relief part is formed of a type of material different from a type of material of the first and second winding portions;

coupling parts symmetrically disposed to each other on the outsides of the first and second winding portions, respectively;

wherein the tolerance relief part is elastically deformable in the longitudinal direction.

2. The magnetic device according to claim 1, wherein each of the coupling parts comprises a hook latched on an outer surface of the core in the longitudinal direction.

3. The magnetic device according to claim 1, further comprising a partition wall protruding outward between the first winding part and the coupling part in the width direction crossing the longitudinal direction.

4. The magnetic device according to claim 3, further comprising reinforcements disposed on the outside of the partition wall in the longitudinal direction and the outside of the coupling part in the width direction.

5. The magnetic device according to claim 2, wherein the core comprises:

an end part on which the hook is latched; and a central part extending inward from the end part in the longitudinal direction, wherein the central part is insertable into the hollow portion of the bobbin.

6. The magnetic device according to claim 5, further comprising an outer extending part extending in parallel with the central part from the outside of the central part disposed in the width direction of the central part.

7. The magnetic device according to claim 5, wherein the end part has a shape in which at least one portion gradually increases in width from the center to the outside when viewed in the longitudinal direction.

8. The magnetic device according to claim 1, wherein the coils comprise a first coil and a second coil;

the first and second coils are spaced apart from each other with the tolerance relief part disposed therebetween.

9. The magnetic device according to claim 1, wherein the top side of the tolerance relief part is integrally formed with the first winding portion and the bottom side of the tolerance relief part is integrally formed with the second winding portion.

10. The magnetic device according to claim 1, wherein at least one of the coils is wound over an external surface of the curved shape portion of the tolerance relieve part.

* * * * *